United States Patent [19]

Valavaara

[11] Patent Number: 4,924,901

[45] Date of Patent: May 15, 1990

[54] IN LINE VALVE

[75] Inventor: Viljo K. Valavaara, Mississauga, Canada

[73] Assignee: Fluid Jet International Inc., Toronto, Canada

[21] Appl. No.: 357,294

[22] Filed: May 26, 1989

Related U.S. Application Data

[63] Continuation-in-part of Ser. No. 259,903, Oct. 19, 1988, abandoned.

[51] Int. Cl.[5] ..... F16K 11/10

[52] U.S. Cl. ..... 137/102; 137/627.5

[58] Field of Search ..... 137/596, 596.2, 102, 137/627.5, 115

[56] References Cited

U.S. PATENT DOCUMENTS

| | | | |
|---|---|---|---|
| 2,126,140 | 8/1938 | Ross | 137/102 X |
| 2,807,215 | 7/1955 | Hawthurst . | |
| 3,811,798 | 5/1974 | Bickford . | |
| 4,243,064 | 1/1981 | Nolte | 137/115 |

OTHER PUBLICATIONS

Aquadyne Inc. Brochure; Hydraulic Institute Standards; "Calculating Volumetric Efficiency".

*Primary Examiner*—Alan Cohan

[57] ABSTRACT

A valve for use in association with a pressure chamber and having a valve body with a passageway therethrough, and an upstream valve surface and a downstream valve surface, an inlet conduit formed in the valve body communicating with the upstream surface, a valve stem located within the passageway adapted to permit flow of fluid through the passageway, an upstream valve head attached to the stem to seal the inlet conduit, an outlet conduit in the valve head to permit flow from the pressure chamber to the valve passageway, and a valve cap on the other end of the valve stem, the valve head and valve cap being movable relative to one another. Also disclosed is a piston for use in conjunction with such a valve having a configuration to reduce unswept volume.

9 Claims, 3 Drawing Sheets

IN LINE VALVE

This application is a continuation-in-part of Ser. No. 259,903, filed on Oct. 19, 1988, Title: In Line Valve, Inventor: W. K. Valavaara now abandoned.

The invention relates to a two-way valve for use in association with systems for generating pressurized fluids such as liquids, and to a piston or plunger for use in association therewith.

BACKGROUND OF THE INVENTION

Systems for pressurizing fluids such as liquids include pumps, intensifiers, and other devices for producing pressures. In the majority of cases, valve means are provided whereby fluid can pass into and out of a pressure chamber.

In some cases, two openings and two valves are provided, such as is shown in U.S. Pat. No. 2,807,215. Such a two-valve system involves the use of two separate openings into the pressure chamber and, in many cases, this is not desirable.

Preferably, only a single opening will be provided into the chamber, through which fluid is both admitted and discharged. In order to control the inflow and outflow of fluid, it is known to provide two valves connected to the single opening. One such system is shown in U.S. Pat. No. 3,811,798. In this system, however, the arrangement of the two valves is such that they are located on an axis which is transverse to the axis of the pressure chamber. Consequently, the efficiency of the device as a pressurizing device is significantly reduced. That portion of the transverse valve passage which communicates with the pressure chamber constitutes an unswept volume. The efficiency of this type of pressure device, whether it is a pump or an intensifier, depends to a large extent on reducing the unswept volume to a minimum.

At moderate pressures, e.g. in the range of 1,000 psi, the unswept volume is not a critical factor.

However at high pressures, e.g. in the range of 30,000 psi, major losses in efficiency are experienced due to excessive unswept volume.

In a typical arrangement using two valves on a transverse axis where there is significant unswept volume, efficiency at 1,000 psi might be 97%. However at 30,000 psi efficiency drops to around 68%. This is caused principally by the compressibility of liquids, i.e., water, at these high pressures.

Accordingly for these higher pressure ranges, the industry has adopted a valve arrangement in which the two valves are located on a common axis, along the axis of the pressure chamber. Even this so called "In line" valve arrangement results in significant losses due to unswept volume, due to various design factors.

In particular, valve springs were sometimes used, located within the pressure chamber, which resulted in unswept volume.

BRIEF SUMMARY OF THE INVENTION

With a view to overcoming these various disadvantages, the invention comprises a valve for use in association with a pressure chamber having a predetermined axis, and comprising valve body means defining a valve passageway therethrough, and defining an upstream valve surface and valve opening, and a downstream valve surface and valve opening, said upstream valve surface being adapted to be located in communication with said pressure chamber, inlet conduit means formed in said valve body means, and communicating with said upstream valve surface, and adapted to be connected to a supply of fluid, valve stem means located within said valve passageway, and being adapted to permit flow of fluid through said valve passageway, upstream valve head means attached to said valve stem means, and adapted to seal over said inlet conduit means in said upstream valve surface, discharge means in said valve head means adapted to receive fluid from said pressure chamber, and, valve cap means on said valve stem means remote from said valve head means, said valve cap means being movable relative to said valve head means, and being adapted to close said downstream valve opening at said downstream valve surface.

More particularly, it is an objective of the invention to provide a valve having the foregoing advantages wherein said valve cap means and said valve head means are connected through spring biassing means, whereby to simultaneously bias both said valve head means and said valve cap means into their closed position.

More particularly, it is an objective of the invention to provide a valve having the foregoing advantages wherein said valve head means comprises a flattened generally circular member, and wherein said discharge conduit means are formed therein at an angle to the axis of said pressure chamber.

More particularly, it is an objective of the invention to provide a valve having the foregoing advantages wherein said valve stem means comprises a tubular member, communicating with said discharge means in said valve head means, and to transmit fluid to said downstream valve opening.

It is a related objective of the invention to provide a valve having the foregoing advantages wherein said valve head is movable relative to said valve stem.

More particularly, it is an objective of the invention to provide a valve having the foregoing advantages and wherein said valve cap is movable relative to said valve stem.

More particularly, it is an objective of the invention to provide a valve having the foregoing advantages and wherein said valve head has a predetermined diameter less than the diameter of said pressure chamber, and including plunger means in said pressure chamber, said plunger means being shaped and adapted to fit over and around said valve head.

It is a related objective of the invention to provide a pressure chamber and piston means, and having a valve having the foregoing advantagtes and wherein said valve stem comprises a hollow tubular member, including a central axial discharge opening means in said valve head, and including piston means in said pressure chamber, said piston means including an elongated plunger adapted to fit within said discharge opening means and said tubular valve stem.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
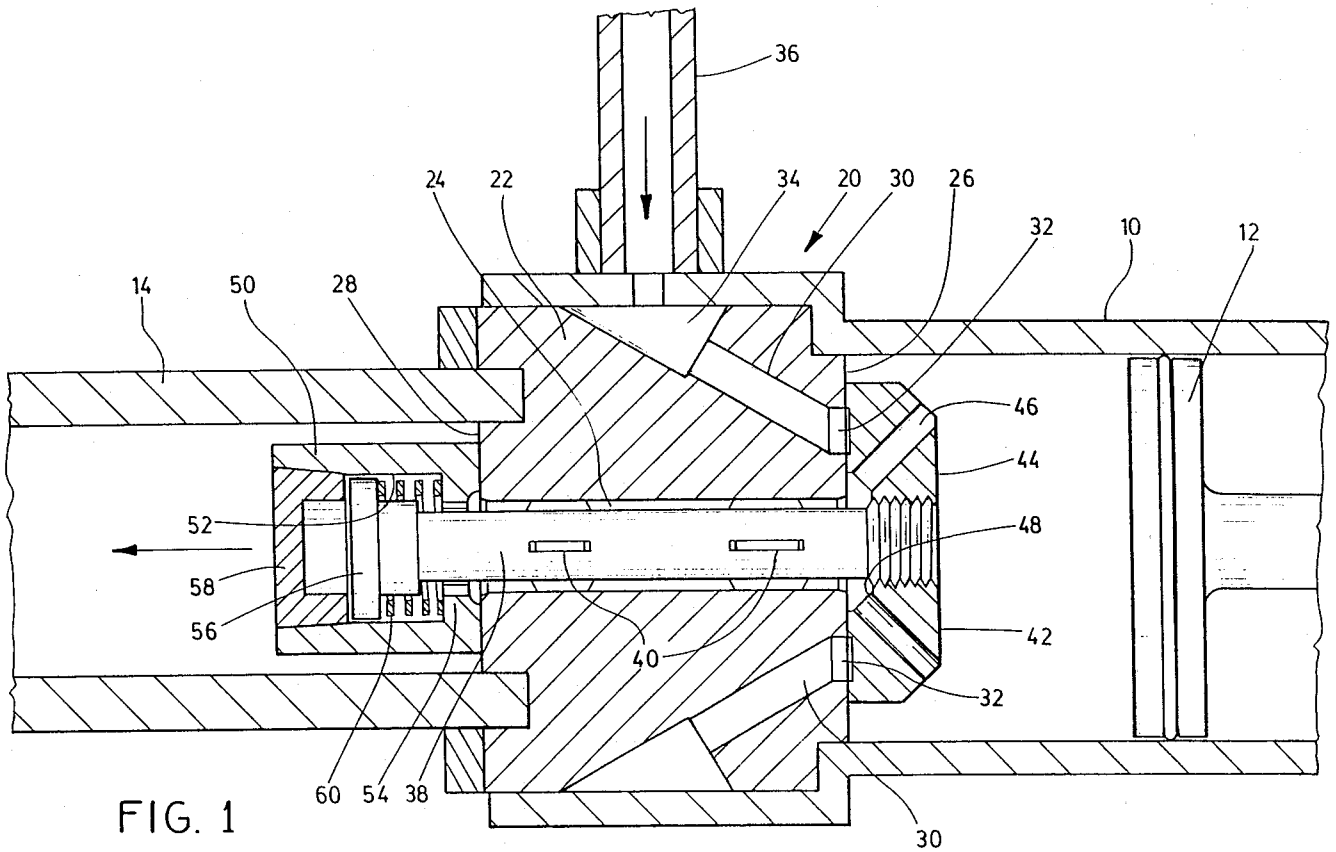
FIG. 1 is a sectional illustration showing in schematic form a pressure chamber, and pressure piston, and showing the valve in accordance with the invention shown in association therewith, the valve being shown in its closed position.

Referring first of all to FIG. 1, it will be seen that the valve in accordance with the invention is illustrated in association with a pressure chamber 10, having a pressure piston 12 therein. The pressure chamber 10 and piston 12 are shown schematically solely for the purposes of illustration. The invention is clearly not limited to use solely in association with chambers and pistons of this type, but may be used in a variety of different applications where fluids may be pressurized.

It will of course be appreciated that the representation of a piston is purely schematic. In many devices of this kind, a plunger is used as the displacement member.

The showing of a piston therefore is purely representative of any displacement member whether a piston or a plunger or of some other kind. It will also be appreciated that suitable seals will be provided where necessary as is well known in the art. Such seals are omitted from this disclosure for the sake of clarity.

Also shown in schematic form is a downstream conduit 14, again being shown purely for the purposes of illustration and explanation, and without limitation.

The valve, in accordance with one embodiment of the invention, is illustrated generally as 20. It will be seen to comprise a valve body member 22, defining a central through-valve passageway 24. The valve body 22 defines an upstream valve surface 26 and a downstream valve surface 28, surrounding the upstream and downstream ends of the through valve passageway 24.

Inlet conduit means, in this case a plurality of inlet conduits 30, are formed within body 22, and terminating in inlet openings 32. Conduits 30 communicate with an annular supply channel 34 which is, in turn, supplied from any suitable source such as the supply conduit 36. Fluid to be pressurized, for example, water will be supplied through conduit 36 to channel 34 and thence through conduits 30, to openings 32.

Other fluids may, of course, be used, water being indicated simply for the purposes of explanation.

A valve stem member 38 extends through passageway 24, and has a predetermined diameter less than that of passageway 24, so as to permit flow of pressurized fluid therearound. A plurality of spacer fins 40 locate the stem member 38 centrally along the axis of passageway 24.

Fins 40 may be integral or may be formed, for example, of metal, or plastic material, with a streamlined profile. They may be installed in recesses (not shown) in stem 38, or in passageway 24.

A valve head 42 is attached to the upstream end of stem 38, and is located within pressure chamber 10, in this particular embodiment. It is generally circular in shape, and is adapted to overlie and close the inlet openings 32. For this purpose, the head 42 is adapted to seat on the upstream valve surface 26 around each of the inlet openings 32.

Valve head 42 is formed with a shoulder 44, through which angled outlet conduits 46 are formed. Outlet conduits 46 extend diagonally through head 44, and communicates with an interior recess 48. Fluid is thus permitted to flow through conduit 46 and into passageway 24, unhindered by head 42.

On the downstream end of stem 38, a valve cap 50 is movably located. Cap 50 defines an interior chamber 52, having a collar or neck portion 54 formed thereon, defining an opening adapted to encircle stem 38.

A retaining body 56 is formed on or attached to stem 38, which is unable to pass through neck 54.

A closure 58 is received in body 50 so as to retain retaining body 56 therein.

In this particular embodiment, a biasing spring 60 is located within body 50, being in compression, between neck 54 and retaining body 56. In certain embodiments, however, the spring may be dispensed with.

In operation, FIG. 1 shows the condition where the valve is closed. The head 42 is seated on the upstream surface 26 and the cap 50 is seated on the downstream surface 28.

Once the pressure piston or plunger such as 12 is operated however, it will be reciprocated through alternate inlet and outlet strokes. These are illustrated respectively in FIGS. 2 and 3 with respect to the valve position.

Figure 2:
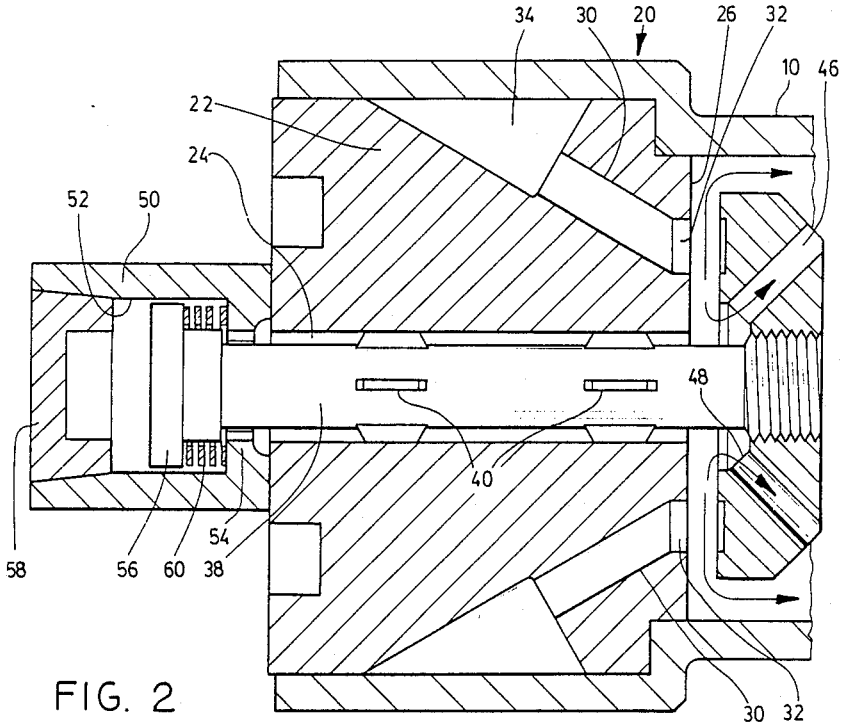
FIG. 2 is a corresponding section of the valve of FIG. 1, shown in the intake open position.

As shown in FIG. 2, on the inlet stroke, the pressure within pressure chamber 10 will drop as the piston 12 moves on its inlet stroke, and the incoming fluid from conduit 36 will thus overcome the biasing force of spring 60, causing head 42 to lift off upstream surface 26. This will then allow the fluid to flow into the chamber 10.

As soon as chamber 10 is filled and the piston 12 starts its pressure or discharge stroke, the pressure will then cause valve head 42 to seat on upstream surface 26 closing the inlet openings 32.

Figure 3:
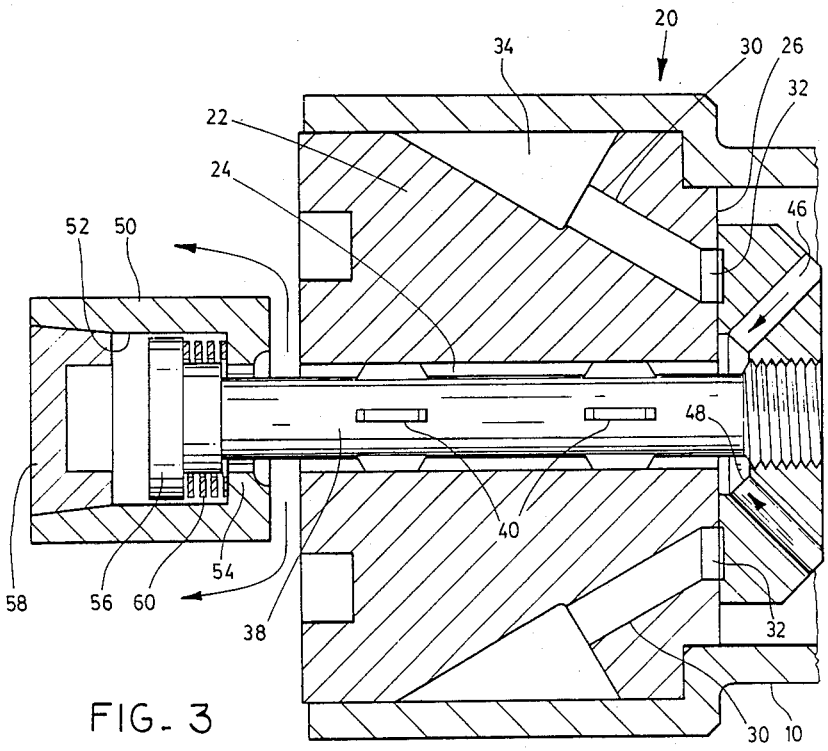
FIG. 3 is a corresponding section of the valve shown in its outlet open position, and, FIG. 4 is a sectional view of a valve in accordance with an alternate embodiment, and showing an alternate embodiment of piston and plunger means.

Fluid will then commence passing through conduits 46, and along passageway 24. This fluid will then cause cap 50 to lift off downstream surface 28 as shown in FIG. 3. This will allow the pressurized fluid to flow down conduit 14.

The operation of the valve is thus self-regulating, and although a spring is illustrated, and may be used in some cases, it can in practice be dispensed with in many cases. This would provide a valve having a long working life and requiring little or no maintenance.

It will be seen that the unswept volume in the valve is minimized, and the swept volume in the chamber is maximized due to lack of interference in the chamber from any valve components, other than head 42.

Usually in a typical pump or intensifier, there will be a plurality of chambers and plungers which will be operating in sequence to provide a stream or jet of liquid.

Downstream valve cap 50 will prevent pressurized liquid from entering the downstream end of the valve passageway during the pressure strokes of plungers in other chambers.

Figure 4:
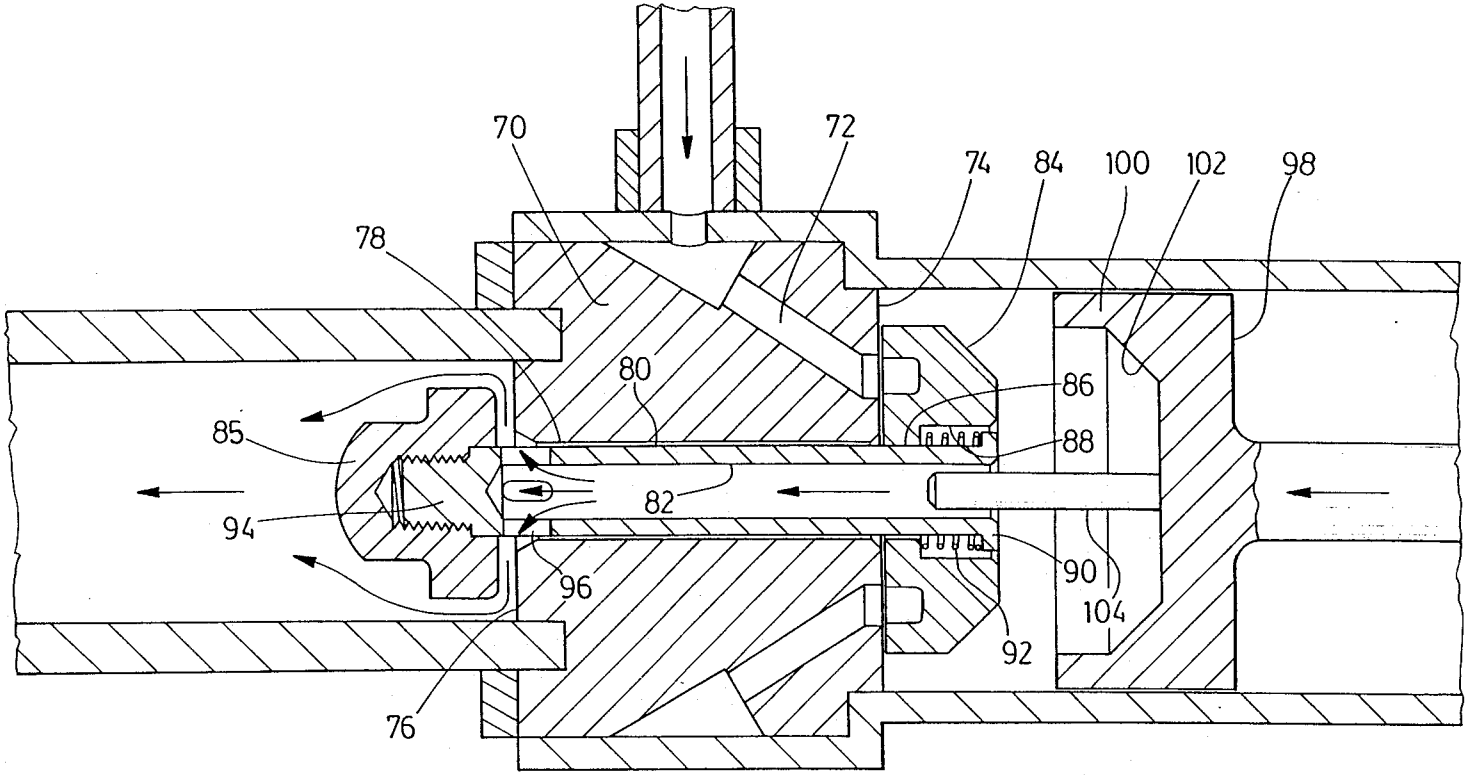

In accordance with an alternate embodiment, provision may be made to still further reduce the unswept volume. As illustrated in FIG. 4, this alternate embodiment of the invention comprises a valve body 70 within that opening 72, and an upstream surface 74 and a downstream surface 76 essentially similar to that shown in the embodiment of FIG. 1. A valve passageway 78 extends from the upstream surface to the downstream surface, and defines upstream and downstream openings respectively.

A valve stem 80 extends through passageway 78. Stem 80 will be seen to be of tubular construction defining an interior passageway 82. At the upstream end of stem 80, valve head 84 is located, and at the downstream end of stem 80, valve cap 85 is located. Valve head 84 is adapted to cover the open ends of inlet passageway 72. Valve head 84 is provided with a passageway 86 and a counter bore 88. Valve stem 80 has at its upstream end a flange 90, received within counter bore 88. A spring 92 is engaged between flange 90 and head 84, within counter bore 88. Thus valve head 84 is movable relative to valve stem 80 and thus relative to valve cap 85.

Valve cap 85 is secured to a boss 94, by threaded engagement means, and thus moves together with valve stem 80. Valve stem 80 is provided with a plurality of radial openings 96 adjacent valve cap 85, through which fluid passing through bore 82, may escape around cap 85.

Thus the essential characteristics of the valve of the embodiment of FIG. 4 are generally similar to that of the valve of FIGS. 1 to 3, namely valve head 84 is movable relative to the valve cap 85, and fluid is adapted to pass into the chamber, when valve head 84 lifts off upstream surface 74, and fluid is adapted to be discharged from the chamber, when valve cap 85 lifts off downstream surface 76.

The principal difference in this embodiment is that the fluid passes through passageway 84 in head 84 and through the central bore 82 within the valve stem 80, instead of passing through the valve passageway itself, around the exterior of the valve stem.

In order to still further reduce the unswept volume, a piston 98 is provided, of a special design. Piston 98 is formed with a forwardly extending collar 100. Collar 100 is formed with a shoulder 102. Shoulder 102 and collar 100 are shaped to conform to the profile of valve head 84. Valve head 84 is of reduced diameter in relation to the chamber, and collar 100, therefore, fits within the space between the valve head 84 and the wall of the chamber, and thus éliminates the unswept volume occurring at that point.

In addition, an elongated generally cylindrical plunger 104 is formed along the central axis of piston 98. Plunger 104 is adapted to enter the passageway 82 in valve stem 80. Plunger 104 is not intended to make a snug fit, but rather to reduce the volume of the passageway 82, at the end of the piston stroke. In this way, the fluid remaining in the space between the piston 98, and the head 84, will still be free to pass around the plunger 104 through the passageway 82.

While the surfaces of the valve head and the valve cap, and the upstream and downstream surfaces are illustrated herein as being metal to metal surfaces, it will be appreciated that in certain cases seals of various types, may be incorporated for example in suitable recesses (not shown) typically in the upstream and downstream valve surfaces.

In addition, while the foregoing specification has generally described the invention as being used in association with liquids, it will be appreciated that the invention is also applicable to operation with gases, and the term fluid as used herein is intended to have its generic meaning encompassing both gases and liquids, and wherever the term fluid or fluids is used in the specification, or in the claims, it is to be interpreted as meaning either gases or liquids.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A valve for use in association with a pressure chamber having a predetermined axis, and comprising:
   - valve body means and defining an upstream valve surface and a downstream valve surface said upstream valve surface being adapted to be located in communication with said pressure chamber;
   - valve passageway means extending through said valve body means whereby to permit flow of fluid from said pressure chamber;
   - inlet conduit means formed in said valve body means, and communicating with said upstream valve surface, and adapted to be connected to a supply of fluid;
   - valve stem means located within said valve passageway means, and having a predetermined cross-section whereby to permit flow of fluid;
   - upstream valve head means connected to said valve stem means and having discharge conduit means therethrough, and adapted to seal over said inlet conduit means in said upstream valve surface, and,
   - valve cap means connected to said valve stem means adjacent said downstream valve surface, said valve cap means being movable, whereby to permit flow of fluid downstream, through said valve passageway means.

2. A valve as claimed in claim 1 wherein said valve cap means and said valve stem are connected through spring biassing means, whereby to simultaneously bias both said valve head and said valve cap into their closed position.

3. A valve as claimed in claim 1 wherein said valve head comprises a flattened generally circular member, and wherein said discharge conduit means is formed therein at an angle to the axis of said pressure chamber.

4. A valve as claimed in claim 1 wherein said valve body means defines a through bore, in turn defining said valve passageway means, and wherein said valve stem means has a predetermined diameter less than the said through bore, whereby to permit flow of fluid within said through bore around said valve stem means.

5. A valve as claimed in claim 1 wherein said valve cap means is secured to said valve stem means, and wherein said valve head means is movable relative to said valve stem means, and including spring biassing means urging said valve head means to close.

6. A valve as claimed in claim 1 wherein said valve head means is secured to said valve stem means, and wherein said valve cap means is movable relative to said valve stem means, and including spring means urging said valve cap means to close.

7. A valve as claimed in claim 1 wherein said valve stem means comprises a hollow tubular member, and defining said valve passageway means, for passage of fluid from said pressure chamber.

8. A valve as claimed in claim 7 wherein said valve stem means defines an upstream and a downstream end, and including opening means at said upstream end for entry of the pressurized fluid, and further opening means at said downstream end for flow of fluid therefrom.

9. A valve as claimed in claim 8 wherein said upstream opening means defines said discharge conduit means in said valve head means, to permit passage of fluid therethrough.

* * * * *